United States Patent [19]

Sano et al.

[11] 3,984,594

[45] Oct. 5, 1976

[54] METHOD FOR PRODUCING CELLULOSIC FIBER-CONTAINING YARNS WITH A NON-AQUEOUS SIZING SOLUTION

[75] Inventors: Junzi Sano, Amagasaki; Kiyoshi Aoki; Syoso Makino, both of Osaka, all of Japan

[73] Assignee: Kanebo, Ltd., Tokyo, Japan

[22] Filed: Aug. 23, 1974

[21] Appl. No.: 500,071

[30] Foreign Application Priority Data

Aug. 29, 1973 Japan ..... 48-97506
Aug. 29, 1973 Japan ..... 48-97507

[52] U.S. Cl. ..... 427/392; 428/378; 428/393; 28/72.6

[51] Int. Cl.[2] ..... B05D 3/02; B32B 23/02

[58] Field of Search ..... 117/139.5 A, 161 UC; 28/72.6; 428/378, 393; 260/33.8 UA, 33.6 UA; 427/392

[56] References Cited

UNITED STATES PATENTS

| | | | |
|---|---|---|---|
| 2,169,558 | 8/1939 | Dittmar | 117/116 UC X |
| 2,652,349 | 9/1953 | Bihaly | 117/161 UC |
| 2,712,683 | 7/1955 | Gaunt et al. | 117/139.5 A X |
| 2,868,676 | 1/1959 | Ljungbo | 117/161 UC X |
| 2,923,646 | 2/1960 | Jordan | 117/161 UC X |
| 2,998,326 | 8/1961 | Ellenbogen et al. | 117/161 UC X |
| 3,118,786 | 1/1964 | Katchman et al. | 117/161 UC X |
| 3,138,568 | 6/1964 | Sears | 117/161 UC X |
| 3,194,777 | 7/1965 | Christenson et al. | 117/161 UC X |
| 3,316,123 | 4/1967 | Savina et al. | 117/161 UC |
| 3,496,006 | 2/1970 | Rideout et al. | 117/161 UC X |
| 3,728,299 | 4/1973 | Schramm | 117/139.5 A X |

OTHER PUBLICATIONS

Mikhailova et al., Abstract of article in Izv. Vyssh. Ucheb. Zaved., Tekhnol. Tekst. Prom. (Russ.), 1972, pp. 71–75, published in Chem. Abstracts, vol. 77, No. 2, Abstract No. 7075b, July 1972.

Ijichi et al., Abstract of Jap. Patent No. 73 23,996, filed Sept. 18, 1969, published in Chem. Abstracts, vol. 80, No. 24, Abstract No. 134819j, June 1974.

Nozaki, Abstract of Jap. Patent No. 73 07,917, filed Mar. 11 1968, published in Chem. Abstracts, vol. 80, No. 12, abstract No. 60991k, Mar. 1974.

*Primary Examiner*—Ronald H. Smith
*Assistant Examiner*—Evan K. Lawrence
*Attorney, Agent, or Firm*—Paul & Paul

[57] ABSTRACT

A sized cellulosic fiber-containing yarn having an excellent weaving property and processing property is provided by sizing, in a non-aqueous medium, with a copolymer prepared by copolymerizing 20 to 80% by weight of at least one monomer selected from the group consisting of methyl methacrylate, styrene and acrylonitrile and 80 to 20% by weight of at least one monomer selected from the group consisting of acrylic esters of aliphatic alcohols having 1 to 8 carbon atoms and methacrylic esters of aliphatic alcohols having 4 to 8 carbon atoms, and removing the non-aqueous medium from the yarn, the copolymer having a glass transition temperature of 40° to 80°C and a Young's modulus of $1 \times 10^3$ to $1 \times 10^4$ kg/cm².

12 Claims, 2 Drawing Figures

C: RESISTANCE TO ABRASION
750
500
250
0
A: YOUNG'S MODULUS (kg/cm²)
10⁴
10³
10²
10
B: GLASS TRANSITION POINT (°C)
100
50
0
-50
A
B
C
POLYBUTYL ACRYLATE
POLYETHYL ACRYLATE
POLYMETHYL ACRYLATE
POLYVINYL ACETATE
POLYVINYL ALCOHOL
POLYMETHYL METHACRYLATE
POLYACRYLO-NITRILE
POLYSTYRENE

METHOD FOR PRODUCING CELLULOSIC FIBER-CONTAINING YARNS WITH A NON-AQUEOUS SIZING SOLUTION

BACKGROUND OF THE INVENTION

The present invention relates to a method for sizing a cellulosic fiber-containing yarn with a sizing agent consisting of a synthetic copolymer in a non-aqueous medium. More particularly, the present invention relates to a method for sizing a cellulosic fiber-containing spun yarn with an non-aqueous solution of an acrylic or methacrylic copolymer in a halogenated hydrocarbon solvent, in order to prepare a sized yarn having excellent desizing, weaving and processing properties.

It is known that in order to smoothly carry out a weaving process for a spun yarn, it is important that the warp spun yarn is appropriately sized with a sizing agent. In this case, it is required that the sized warp yarn be pertinent to the effect the weaving process with a high efficiency and with no or very few number of yarn breakages and that the sized yarn fabric can be easily completely desized in a simple process. Further, it is required that the sized yarn fabric has excellent processing property, for example, scouring, bleaching and dyeing properties. The term "processing property" used herein, refers to a property of the sized yarn fabric such that the sized yarn fabric can be easily processed into a processed fabric, for example, scoured, bleached or dyed fabric, having a uniform quality.

In conventional sizing methods, the cellulosic fiber-containing yarn is sized with an aqueous solution of a water-soluble sizing agent such as starch, polyvinyl alcohol, water-soluble salts of polyacrylc acid, water-soluble salts of partially esterified polyacrylic acid, and mixtures of two or more of the above-mentioned sizing agents. If the cellulosic fiber-containing yarn is sized by the conventional method stated above, it is difficult to completely desize the sized yarn. Even if the sized yarn is completely desized, the desizing process is complicated or expensive, or requires a large amount of water. Recently, it has become an increasingly important requirement that the desizing process be effected in a simple process without polution and using no or a small amount of water. In order to meet with this requirement, a sizing process for cellulose fiber-containing yarn with a synthetic sizing agent in a non-aqueous solvent, has been developed. The synthetic sizing agent can be removed from the yarn by treating the sized yarn in a non-aqueous organic solvent.

However, it is difficult for the conventional synthetic sizing agents to satisfy all of the following requirements:

1. high adhesive property of the sizing agent for the fibers in the yarn to be sized;
2. no or very few formations of fluff on the sized yarn fabric during weaving;
3. easy shedding of warp yarns in the weaving process;
4. high lubricity of the sized yarn;
5. no or very small separation of the sizing agent from the yarn during the weaving process;
6. no difficulty in supply of the yarn from a reed in a loom;
7. appropriate softness of the sized yarn;
8. proper hardness of the film of the sizing agent formed on the sized yarn;
9. high efficiency in the weaving process;

10. no formation of defects for example, warp streak, warp falling, uneven gloss, on the sized yarn fabric;
11. high desizing property, and;
12. simple operation in the desizing process.

For example, the Japanese Patent Application Publication No. 12559/1972 discloses a process for sizing, in a non-aqueous solvent, with a synthetic sizing agent consisting of a four-component copolymer containing, for example, acrylic acid and vinyl acetate. The Japanese Patent Application Publication No. 27089/1973 discloses a process for sizing, in a non-aqueous medium consisting of a halogenated hydrocarbon, with a three-component copolymer containing acrylic acid or methacrylic acid and two kinds of esters. The sizing agent copolymers mentioned above are pertinent for sizing the synthetic fiber yarns due to their high adhesive property for the synthetic fiber yarns. Further, the sizing agent copolymers containing a copolymerized organic acid component such as acrylic acid and methacrylic acid, can be easily desized by treating the sized yarn fabric with an alkali aqueous solution. That is, during the treatment, the organic acid component of the copolymer is converted into a water-soluble organic acid salt component, and as a result of the conversion, the copolymer is solubilized in water. The solubilized copolymer is easily removed from the fabric by washing with cold or hot water. However, it has been discovered by the inventors that the copolymers having such organic acid component are not suitable for sizing the cellulose fiber-containing yarns. This is because the organic acid-containing copolymers have a relatively high hygroscopic property and a relatively high affinity to the cellulosic fiber.

Since cellulosic fiber has a high hygroscopic property, if the cellulose fiber yarn is sized by the organic acid-containing copolymer, the resulting sized yarn has a high hygroscopic property. Such hygroscopic yarn varies in its tensile strength and elongation depending upon the variation of temperature and humidity. This variation results in large number of yarn breakages during the weaving process.

Further, the organic acid copolymer is difficult to desize from the cellulosic fiber yarn due to its high affinity to the cellulosic fiber. Even if it seems that the copolymer is almost completely desized from the cellulosic fiber yarn by an organic solvent, a very small amount of the copolymer retained in the cellulosic fiber yarn results in non-uniformity in quality of the scoured, bleached or dyed fabric. If the copolymer is removed from the cellulosic fiber yarn by using the alkali aqueous solution, it results in consumption of a large amount of water. In order to solve the above-mentioned difficulty in the sizing process for the cellulosic fiber-containing yarn with a synthetic sizing agent in a non-aqueous medium and desizing process for the synthetic sizing agent, the inventors have thoroughly studied the preparation and property of the conventional synthetic sizing agents and new sizing agents, utilization of desizing solvents, and kinetic property of the sizing agents during the weaving process for the cellulosic fiber-containing yarns, and the influence of the sizing agent retained in the cellulosic fiber-containing yarn fabrics on the processing property, for example, scouring, bleaching and dyeing properties. As a result of the study, the inventors have discovered the following facts:

1. When a yarn sized with a polyvinyl acetate or polyvinyl chloride is used as a warp for weaving a fabric, a large amount of sizing agent polymer is separated from the yarn, the separated sizing agent polymer falls down onto a reed of the loom and obstructs the movement of the reed, many warps are broken and many fluffs are formed on the woven fabric. Accordingly, this type of sized yarn cannot be used for weaving for a long period of time. The above-stated disadvantages may be because the sized warp yarn is quickly abraded at a high velocity when the reed moves up and down.

2. The copolymers containing a copolymerized organic acid component are superior in adhesive property for the cellulosic fibers and obstructive property for the formation of fluffs on the woven fabric. However, since such kinds of copolymers and cellulosic fibers are sensitive to humidity, the cellulosic fiber-containing yarns sized by the organic acid-containing copolymer have large variations in tensile strength and elongation with the change of humidity and temperature during the weaving operation. This results in frequent breakages of the warp.

Further, due to the high affinity of the organic acid-containing copolymers to the cellulosic fibers, it is very difficult to completely desize the copolymers from the sized cellulosic fiber-containing yarn fabric. A small amount residue of the copolymer in the fabric causes remarkable unevenness in the scouring, bleaching and dyeing property of the sized yarn fabric. Still further, the application of the copolymer results in an increase in the hardness of the sized yarn and formation of uneven gloss on the woven fabric. If a large amount of the copolymer is applied to the yarn, it is necessary to mix an amount of a lubricating agent into the copolymer in order to avoid the above-mentioned disadvantages.

3. Only copolymers having both the glass transition point and Young's modulus within a special range have a good weaving property.

4. The halogenated hydrocarbon and petroleum solvents are proper as the solvent for sizing agent copolymers for the cellulosic fiber-containing yarns. Especially, the halogenated hydrocarbon can provide a sizing agent solution having a high desizing property.

SUMMARY OF THE INVENTION

Based on the above discoveries, the inventors have completed the present invention.

The object of the present invention is to provide a method for sizing a cellulosic fiber-containing yarn so as to prepare a sized yarn having excellent desizing, weaving, and processing properties.

The above object is accomplished by the method of the present invention. According to the present invention, the method for sizing cellulosic fiber-containing yarns in a non-aqueous medium comprises the steps of providing a non-aqueous sizing solution by dissolving a sizing agent copolymer in a halogenated hydrocarbon solvent, said copolymer consisting of 20 to 80% by weight of at least one copolymerized monomer component selected from the group consisting of methyl methacrylate, styrene and acrylonitrile and 80 to 20% by weight of at least one copolymerized monomer component selected from the group consisting of acrylic esters of aliphatic alcohols having 1 to 8 carbon atoms and methacrylic esters of aliphatic alcohols having 4 to 8 carbon atoms, and having a glass transition point of 40° to 80°C and a Young's modulus of $1 \times 10^3$ to $1 \times 10^4$ kg/cm$^2$;

impregnating a cellulosic fiber-containing yarn with a desired amount of said non-aqueous sizing solution, and removing said halogenated hydrocarbon solvent from said impregnated cellulosic fiber-containing yarn.

The term "cellulosic fiber-containing yarn" used herein refers to yarns consisting of one or more cellulosic fibers or consisting of a mixture of one or more cellulosic fibers and one or more non-cellulosic fibers. The cellulosic fiber may be cotton fiber, viscose rayon staple of filament or, cuprammonium rayon staple or filament. The non-cellulosic fiber may be a synthetic fiber, for example, polyethylene terephthalate fiber or filament, polycapronamide fiber or filament, polyhexamethyleneadipamide fiber or filament, polyacrylonitrile fiber or polypropylene fiber or filament, or diacetate fiber or filament or triacetate fiber or filament. The yarn may be a spun yarn or filament yarn.

In the component monomers of the copolymers usable for the present invention, the methyl methacrylate, styrene or acrylonitrile component monomer forms a relatively hard polymer, and the acrylic ester or methacrylic ester component monomer forms a relatively soft polymer. Accordingly the methyl methacrylate, styrene or acrylonitrile monomer is referred to as a "hard component monomer" and the above-specified acrylic ester or methacrylic ester monomer is referred to as a "soft component monomer" hereinafter.

The polymer consisting of the hard component monomer has a high cohesive property and can impart a high rigidity to the yarn when the yarn is sized by the polymer. This type of sized yarn has a high efficiency in the weaving process and a high desizing property. However, this type of the sized yarn has a low resistance to abrasion and a high tendency to form cracks, uneven gloss or warp streaks on the woven fabric. Further, sometimes, a large amount of the sizing agent polymer is separated from the sized yarn during the weaving process.

Compared with the above, the polymer consisting of a soft component monomer forms a highly flexible or elastic film on the yarn and, therefore, imparts a high resistance to abrasion to the sized yarn. However, this type of the sized yarn has a low rigidity and a poor desizing property.

BRIEF DESCRIPTION OF THE DRAWINGS

The relationship of the physical property of the synthetic polymeric sizing agent to the resistance to abrasion of the yarn sized by the synthetic polymeric sizing agent, and the relationship between the resistance to abrasion and the weaving property of the sized yarn, will be described in detal hereinafter with reference to the accompanying drawings in which.

DESCRIPTION OF THE PREFERRED EMBODIMENTS

Figure 1:
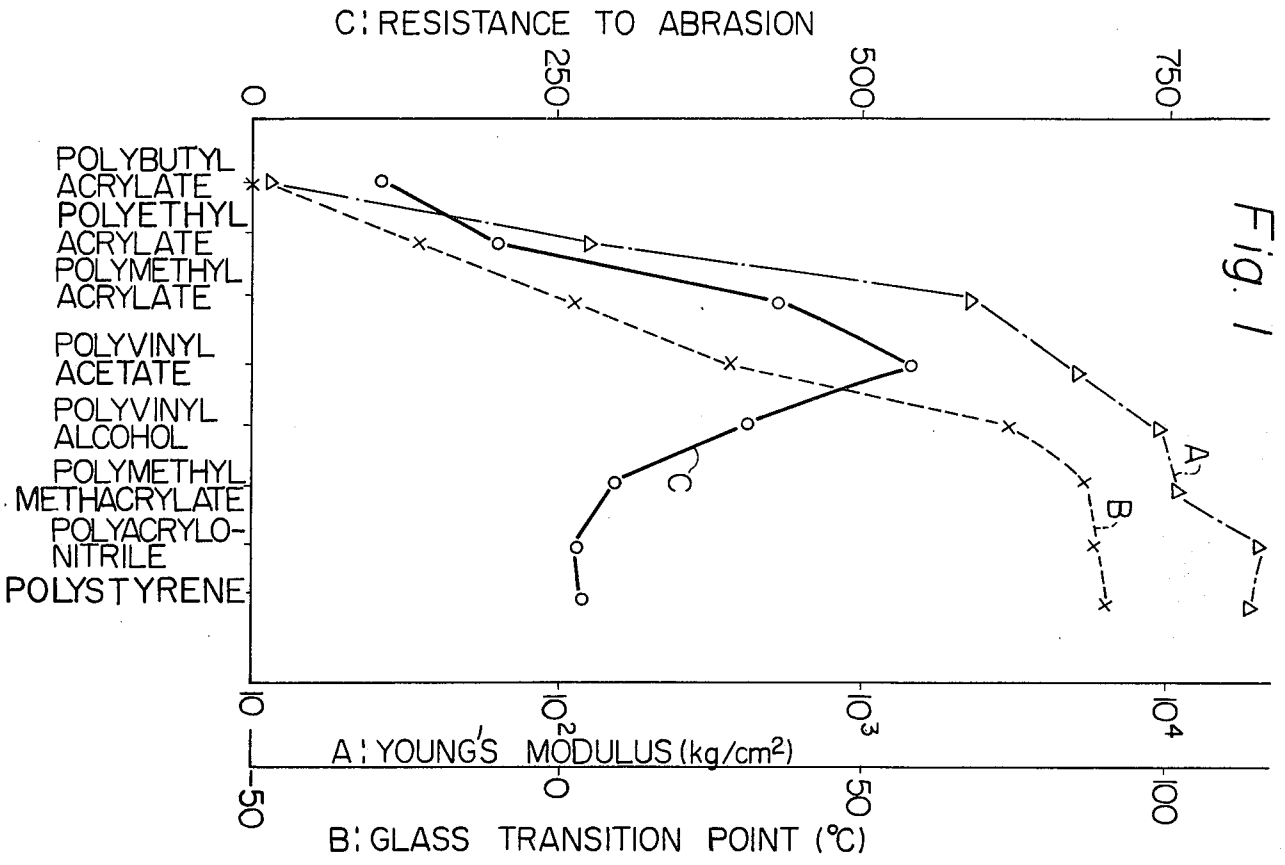
FIG. 1 shows relationships of the glass transition point and the Young's modulus of various synthetic polymers soluble in halogenated hydrocarbon solvents and polyvinyl alcohol to the resistance to abrasion of the sized yarns corresponding to the polymers.

Referring to FIG. 1, various polymers are plotted on the abscissa of the graph in the order of the glass transition points thereof. That is, in the graph, polybutyl acrylate (PBA) has the lowest glass transition point of the polymers plotted on the abscissa and polystyrene (PSty) has the highest. In the driving, Curve A shows the Young's modulus of the polymers, Curve B the glass transition point of the polymers and Curve C the resistance to abrasion of a spun single yarn sized by about 5%, based on the weight of the yarn, of the polymers. The spun yarn consists of a blend of 35% by weight of cotton fibers and 65% by weight of polyethylene terephthalate and has a cotton count of 45 s. The resistance to abrasion is measured by abrading the sized yarn using a TM type abrasion test machine until the yarn is ruptured and is indicated by the number of abrasion cycles required to rupture the yarn. The glass transition point of the polymer is determined using a differential calorimeter and the Young's modulus is measured at a temperature of 20°C and a relative humidity of 65% using a tensile test machine in accordance with the ordinary methods.

In FIG. 1, the spun yarn sized by polyvinyl alcohol which is usually used as the water-soluble sizing agent, has a resistance to abrasion of about 400.

Figure 2:
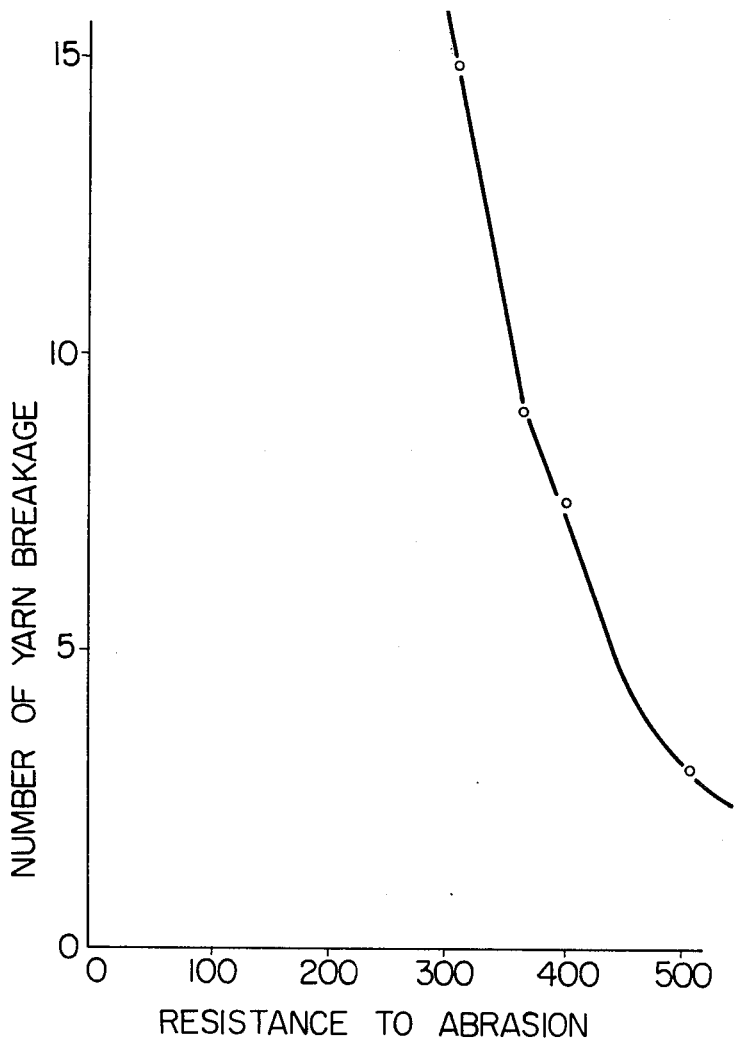
FIG. 2 shows a relationship between the resistance to abrasion and the number of breakages of the sized yarn during the weaving process.

FIG. 2 indicates the fact that there is a close relationship between the weaving property, particularly the number of yarn breakages during the weaving process, and the resistance to abrasion of the same sized yarns. The number of yarn breakages was counted during the weaving of a 60 m length of the fabric using the sized yarn as warp. In FIG. 2, it is obvious that the sized yarns having a resistance to abrasion of 400 or more have a good weaving property. That is, when a sized yarn having a resistance to abrasion of 400 or more is used, the number of yarn breakages is 6 (0.1 breakages in 1 hour) or less. Compared with this, with a sized yarn having a resistance to abrasion of smaller than 400, the number of yarn breakages is very large. If a non-sized yarn is used, it is impossible to continue the weaving process for a long period of time because of frequent yarn breakage.

Referring to FIG. 1, the spun yarns sized by polyvinyl acetate, polymethyl acrylate and polyvinyl alcohol, respectively, have a resistance to abrasion of about 400 or higher. The above mentioned polymers have a glass transition point between 0°C and 80°C and a Young's modulus between $1\times10^3$ and $1\times10^4$ kg/cm$^2$.

However, if a synthetic polymeric sizing agent having a glass transition point lower than 40°C, or a Young's modulus smaller than $1 \times 10^3$ kg/cm$^2$, is used for the cellulosic fiber-containing yarn, the sized yarn has a low lubricity due to the softness of the sizing agent being too high. The low lubricity causes a large friction between the warps (sized yarns) and the reed of a loom during the weaving process. This large friction generates frictional heat on the warps, which results in separation and falling down of a large amount of the sizing agent from the warps onto the reed. The separation of the sizing agent causes interruption of the movement of the reed and a decrease in the resistance to abrasion of the warps. The disadvantages stated above results in an increase of the number of yarn breakages in the weaving process and non-uniform processing property of the woven fabric. If a synthetic polymer having a glass transition point higher than 80°C or a Young's modulus larger than $1 \times 10^4$ kg/cm$^2$ is used as the sizing agent for the cellulosic fiber-containing yarn, the resultant sized yarn has a low resistance to abrasion and poor weaving properties, because the hardness of the polymer is too high.

Accordingly, it is necessary that the polymeric material usable for sizing the cellulosic fiber-containing yarn in a non-aqueous medium has a glass transition point between 40° and 80°C, preferably 65° and 75°C, and a Young's modulus between $1 \times 10^3$ and $1 \times 10^4$ kg/cm$^2$, preferably, $6.5 \times 10^3$ and $8.5 \times 10^3$ kg/cm$^2$. Such special type of synthetic polymeric sizing agents are advantageously selected from the copolymers of the present invention which are prepared by copolymerizing 20 to 80%, preferably 40 to 70%, by weight of at least one hard component monomer selected from the group consisting of methyl methacrylate, styrene and acrylonitrile and 80 to 20%, preferably, 60 to 30% by weight of at least one soft component monomer selected from the group consisting of acrylic esters of aliphatic alcohols having 1 to 8 carbon atoms and methacrylic esters of aliphatic alcohols having 4 to 8 carbon atoms. This special type of copolymer is very useful as a sizing agent for the cellulosic fiber-containing yarn. The yarns sized by this special type of the copolymer have a pertinent rigidity and flexibility, a high resistance to abrasion, a high resistance to formation of fluffs on the yarn surface and a high resistance to separation of the sizing agent from the yarn. Accordingly, the special type of sized yarn prepared by the method of the present invention can be utilized for a weaving process with no or very few breakages of the yarn and a high efficiency. Further, it should be noted that the special type of copolymer can be easily desized from the sized yarn fabric by a simple operation.

As stated above, the hard component monomer usable for the present invention may be methyl methacrylate, styrene, acrylonitrile or a mixture of two or three of the above-mentioned monomers, preferably, methyl methacrylate, styrene or a mixture of these, more preferably, methyl methacrylate.

The soft component monomer usable for the present invention may be selected from acrylic esters of aliphatic alcohols having 1 to 8 carbon atoms, methacrylic esters of aliphatic alcohols having 4 to 8 carbon atoms and mixtures of two or more of the above-mentioned esters. The acrylic ester may be selected from acrylic esters of saturated aliphatic alcohols of 1 to 8 carbon stoms, for example, methyl acrylate, ethyl acrylate, n-propyl acrylate, isopropyl acrylate, n-butyl acrylate, isobutyl acrylate, n-pentyl acrylate, n-hexyl acrylate, n-heptyl acrylate, n-octyl acrylate and 2-ethyl hexyl acrylate and mixtures of two or more of the above-mentioned esters. The methacrylic esters usable for the present invention may be chosen from methacrylic esters of saturated aliphatic alcohols having 4 to 8 carbon atoms, for example, n-butyl methacrylate, isobutyl methacrylate, n-pentyl methacrylate, n-hexyl methacrylate, n-heptyl methacrylate, n-octyl methacrylate and 2-ethylhexyl methacrylate and mixtures of two or more of the above-mentioned esters. Preferably, the soft component monomer is selected from methyl acrylate, ethyl acrylate, butyl-methacrylate, 2-ethylhexyl methacrylate and mixtures of two or more of the above monomers.

More particularly, the copolymers usable for the method of the present invention may be the copolymers of the composition as indicated in Table 1. The table further indicates the glass transition points and the Young's module of the copolymers.

TABLE 1

| No. | Hard component monomer | | | Soft component monomer | | | | | | Physical property | |
|---|---|---|---|---|---|---|---|---|---|---|---|
| | MMA | St | AN | MA | EA | BA | 2-EHA | BMA | 2-EHMA | Glass transition point (°C) | Young's modulus ($\times 10^3$ kg/cm²) |
| 1 | 35 | — | — | 65 | — | — | — | — | — | 41.1 | 3.3 |
| 2 | 50 | — | — | 50 | — | — | — | — | — | 54.6 | 7.2 |
| 3 | 75 | — | — | 25 | — | — | — | — | — | 78.8 | 10.0 |
| 4 | 50 | — | — | — | 50 | — | — | — | — | 41.5 | 2.4 |
| 5 | 70 | — | — | — | 30 | — | — | — | — | 67.9 | 6.3 |
| 6 | 80 | — | — | — | 20 | — | — | — | — | 79.6 | 9.6 |
| 7 | 60 | — | — | — | — | 40 | — | — | — | 40.6 | 4.4 |
| 8 | 70 | — | — | — | — | 30 | — | — | — | 55.7 | 4.8 |
| 9 | 70 | — | — | — | — | — | 30 | — | — | 46.8 | 3.3 |
| 10 | 20 | — | — | — | — | — | — | 80 | — | 41.1 | 4.1 |
| 11 | 35 | — | — | — | — | — | — | 65 | — | 59.2 | 6.3 |
| 12 | 50 | — | — | — | — | — | — | 50 | — | 68.5 | 7.9 |
| 13 | 65 | — | — | — | — | — | — | 35 | — | 69.4 | 8.5 |
| 14 | 80 | — | — | — | — | — | — | 20 | — | 79.8 | 9.1 |
| 15 | 30 | — | — | — | — | — | — | — | 70 | 40.8 | 2.1 |
| 16 | 50 | — | — | — | — | — | — | — | 50 | 56.3 | 7.3 |
| 17 | 70 | — | — | — | — | — | — | — | 30 | 77.0 | 9.1 |
| 18 | — | 35 | — | 65 | — | — | — | — | — | 40.4 | 4.6 |
| 19 | — | 50 | — | 50 | — | — | — | — | — | 52.5 | 6.6 |
| 20 | — | 70 | — | 30 | — | — | — | — | — | 70.9 | 9.5 |
| 21 | — | 50 | — | — | 50 | — | — | — | — | 41.8 | 2.5 |
| 22 | — | 60 | — | — | 40 | — | — | — | — | 53.2 | 7.1 |
| 23 | — | 70 | — | — | 30 | — | — | — | — | 65.4 | 8.8 |
| 24 | — | 60 | — | — | — | 40 | — | — | — | 42.3 | 3.6 |
| 25 | — | 70 | — | — | — | 30 | — | — | — | 54.5 | 4.2 |
| 26 | — | 80 | — | — | — | 20 | — | — | — | 68.8 | 9.3 |
| 27 | — | 70 | — | — | — | — | 30 | — | — | 50.1 | 6.5 |
| 28 | — | 30 | — | — | — | — | — | 70 | — | 47.6 | 3.3 |
| 29 | — | 50 | — | — | — | — | — | 50 | — | 62.3 | 8.5 |
| 30 | — | 70 | — | — | — | — | — | 30 | — | 71.1 | 9.9 |
| 31 | — | 40 | — | — | — | — | — | — | 60 | 52.0 | 7.0 |
| 32 | — | 60 | — | — | — | — | — | — | 40 | 71.0 | 9.3 |
| 33 | — | — | 40 | 60 | — | — | — | — | — | 43.4 | 2.4 |
| 34 | — | — | 50 | 50 | — | — | — | — | — | 53.5 | 6.7 |
| 35 | — | — | 70 | 30 | — | — | — | — | — | 73.7 | 9.8 |
| 36 | — | — | 50 | — | 50 | — | — | — | — | 41.0 | 4.5 |
| 37 | — | — | 60 | — | 40 | — | — | — | — | 53.6 | 5.5 |
| 38 | — | — | 75 | — | 25 | — | — | — | — | 72.5 | 8.6 |
| 39 | — | — | 60 | — | — | 40 | — | — | — | 40.8 | 3.4 |
| 40 | — | — | 70 | — | — | 30 | — | — | — | 56.0 | 5.0 |
| 41 | — | — | 70 | — | — | — | 30 | — | — | 48.7 | 4.8 |
| 42 | — | — | 30 | — | — | — | — | 70 | — | 44.5 | 3.1 |
| 43 | — | — | 50 | — | — | — | — | 50 | — | 63.0 | 7.9 |
| 44 | — | — | 70 | — | — | — | — | 30 | — | 79.8 | 10.0 |
| 45 | — | — | 40 | — | — | — | — | — | 60 | 51.5 | 6.7 |
| 46 | — | — | 60 | — | — | — | — | — | 40 | 74.8 | 9.8 |

Note:
MMA: methyl methacrylate
St: styrene
AN: acrylonitrile
MA: methyl acrylate
EA: ethyl acrylate
BA: n-butyl acrylate
2-EHA: 2-ethylhexyl acrylate
BMA: n-butyl methacrylate
2-EHMA: 2-ethylhexyl methacrylate The copolymer usable for the method of the present invention may be prepared by conventional polymerization methods including solution polymerization, emulsion polymerization, suspension polymerization and pearl polymerization. In order to prepare a sizing solution, the copolymer is dissolved in a halogenated hydrocarbon solvent in a concentration of, preferably, 2 to 13% by weight. The halogenated hydrocarbon solvent may be trichloroethylene, tetrachloroethylene, 1,1,1-trichloroethane, dichloromethane, 1,2,-difluoro-1,1,2,2-tetrachloroethane, 1,1,2-trifluoro-1,2,2-trichloroethane, monofluorotrichloromethane, or a mixture of two or more of the above-mentioned compounds. The solvent is preferably selected from trichloroethylene and tetrachloroethylene due to the high processability of the sized yarn and uniformity in quality of the processed fabric. The concentration of the copolymer in the solvent is appropriately determined in consideration of the kind of the copolymer and the solvent, the specific gravity of the solvent and sizing method. Usually, the concentration is in a range of 2 to 13%, preferably, 4 to 7%, by weight.

In the method of the present invention, the copolymer solution to be used as the sizing solution may include one or more additives such as: lubricant, for example, solid paraffin, liquid paraffin, mineral oil, animal oil, vegetable oil, ester type oil and fatty acid amine; softening, penetrating and lubricating agents, for example, nonionic, anionic, penetrating and lubricating agents, for example, nonionic, anionic, cationic and amphoteric surface active agents, and; anti-static agent. The additive may be separately applied onto the yarn which has been sized by the copolymer.

The copolymer solution is applied to the cellulose fiber-containing yarn by conventional sizing methods, for example, by immersing the yern into the sizing solution, or spraying, brushing or roller coating the sizing solution onto the yarn. In the sizing process, the sizing solution is applied in an amount such that 3 to 20%, preferably 4 to 10%, based on the weight of the yarn to be sized, of the copolymer is held by the yarn. If the amount of the copolymer applied onto the yarn is smaller than 3% by weight, the sized yarn has a low resistance to abrasion and a large number of yarn breakages during the weaving process. If the copolymer is applied in an amount of larger than 20%, a large amount of the copolymer is separated from the sized yarn and falls down onto the reed during the weaving process so as to interrupt the movement of the reed. This results in a poor weaving property. Further, a large amount of the copolymer on the sized yarn causes difficulty in desizing for the sized yarn.

The amount of the copolymer on the sized yarn is adjusted by controlling the concentration of the sizing solution and the amount of the sizing solution to be held on the yarn. The adjustment of the amount of the sizing solution to be applied onto the yarn is carried out by controlling the squeezing operation, using a mangle or a centrifugal, for the yarn immersed into the sizing solution so that a predetermined amount of the sizing solution is picked up by the yarn, or adjusting the density and depth of rollers engraved on the coating roller surface on which the sizing solution is held and, then, transferred onto the yarn.

After applying the sizing solution, the yarn is dried by evaporating the solvent. Although drying at a low temperature results in a low efficiency, the resultant sized yarn has a high desizing property and a high resistance to abrasion.

In order to enhance the lubricity of the sized yarn, a lubricant, for example, liquid paraffin, wax emulsion or a melt of solid wax, may be applied onto the sized yarn by way of roller coating or immersing. The amount of the lubricant to be applied may be in a range of 0.1 to 2.0% based on the weight of the yarn.

The sized yarn prepared in accordance with the method of the present invention has the following advantages:

1. Pertinent rigidity for weaving.
2. Proper flexibility for weaving.
3. High resistance to abrasion.
4. Very small separation of the sizing agent copolymer from the sized yarn during the weaving process.
5. A very small number of yarn breakages during the weaving process.
6. Tensile strength and elongation are independent of variation of temperature and humidity during the weaving process.
7. High desizing property.

Especially, the copolymer of methyl methacrylate with butyl methacrylate or 2-ethylhexyl methacrylate is very important as the sizing agent for the process of the present invention. In the case where the above-mentioned methyl methacrylate copolymers are used for sizing the cellulosic fiber-containing yarns, the fabric prepared from the sized yarn has an excellent uniformity in processing property, for example, scouring, bleaching and dyeing properties.

From the above description, it will be evident that the non-aqueous sizing process of the present invention can be practically and advantageously utilized for sizing cellulosic fiber-containing yarns in the textile industry.

EXAMPLES

The following examples are intended to illustrate the application of the present invention but are not intended to limit the scope thereof.

In the examples, the percentages are by weight unless otherwise stated, and the properties of the sizing agent copolymers, properties of the sized yarns and properties of the fabrics made of the sized yarns were determined by the methods detailed below unless otherwise stated.

1. Properties of the sizing agent

The sizing agent copolymer was formed into a film having a weight of 120 g/m² by the method wherein 2.4 g of the sizing agent copolymer was dissolved into 20 g of trichloroethylene, the solution was spread onto a surface of mercury of 200 cm² and dried at a room temperature to form a film on the mercury surface. The copolymer film was separated from the mercury surface. The glass transition point and Young's modulus of the copolymer film were respectivly determined by using a differential calorimeter and a tensile testing machine. The non-adhesive property of the copolymer film was measured by an adhesion test wherein two films superimposed on each other were placed in a container, air-conditioned at a temperature of 40°C and at a relative humidity of 100% and the films were pressed between two glass plates for 12 hours under a pressure of 200 g/cm². After the pressing was completed, the two films were inspected to see whether or not the two films were adhered to each other. In the following descriptions of the examples, if the films were adhered to each other, the non-adhesive property of the copolymer forming the adhered films is indicated by "adhesive" and if not, the non-adhesive property of the copolymer of the non-adhered films, is indicated by "non-adhesive".

2. Properties of the sized yarn

A. The percentage of the sizing agent copolymer picked up by the yarn was calculated in accordance with the formula:

$$\text{Pick up (\%)} = \frac{Wa - W}{W} \times 100$$

wherein $W$ represents the weight of the yarn to be sized and $Wa$ represents the weight of the sized yarn.

B. The frictional property of the sized yarn was indicated by a kinetic frictional coefficient determined by using a thread tension rubbing tester at a temperature of 20°C and at a relative humidity of 65%, in such a way that the yarn rubbed an edge having an angle of 30° of a knife made of hard rubber at an angle of 90° to the length of the edge.

C. The resistance to abrasion of the sized yarn was measured using a TM type abrasion tester in such a way that the yarn having a 20-cm length was bent at an angle of 90° around a pin having a 0.5-mm diameter and the yarn reciprocally rubbed the pin at an amplitude of 3 cm under a tension of 60 g so that the yarn was abraded by the pin. The resistance was indicated by the number of abrasion cycles at the end of which the yarn was broken by the abrasion.

D. The desizing property of the sized yarn was determined by a method wherein the sized yarn was washed for 10 seconds with trichloroethylene in an amount of 30 times the weight of the sized yarn to be desized and then, the same 10 seconds washing operation was repeated once more. The desizing property of the sized yarn was indicated by a desizing ratio which was calculated in accordance with the formula:

$$\text{Desizing ratio (\%)} = \frac{W - Wd}{Ws} \times 100$$

wherein $W$ represents the weight of the sized yarn, $Wd$ the weight of the desized yarn and $Ws$ the weight of the sizing agent applied onto the yarn.

3. Weaving preperties of the sized yarn

A. Weaving

A plain fabric having a 115-cm width and a preset warp density and weft density was woven from the sized yarn as a warp and a non-sized yarn as a weft, using an automatic loom.

B. Observations were made during the weaving of a plain fabric of 60-cm length regarding, the ease of shedding, how much sizing agent copolymer was separated from the sized yarn and dropped onto a reed of the loom and how many fluffs were produced on the woven fabric. The extent of separation of the sizing agent and formation of fluffs were evaluated using the following classifications:

| | |
|---|---|
| class 1 | negligible |
| class 2 | slightly remarkable |
| class 3 | remarkable |
| class 4 | very remarkable |
| class 5 | extremely remarkable |

C. The number of yarn breakages was counted during the weaving of a 60-cm length of the plain fabric.

4. Processing properties of the sized yarn fabric

A. Processing

The sized yarn fabric was singed and desized by a method wherein the fabric was continuously treated with trichloroethylene contained in a William's unit type desizing machine having three closed treating vessels connected in series. The desized fabric was continuously scoured by a method wherein the fabric was impregnated with an aqueous solution containing 3% of sodium hydroxide and 0.3% of a non-ionic surface active agent, squeezed so that 100% of the aqueous solution based on the weight of the fabric was maintained in the fabric, and, thereafter, heated with saturated steam at a temperature of 100°C for 60 minutes. The fabric was rinsed with water to eliminate the scouring solution.

The scoured fabric was continuously bleached by a method wherein the fabric was saturated with an aqueous solution containing 1.8% of an aqueous solution containing 50% of sodium chlorite and 10% of ethyl tartrate, heated with steam at a temperature of 100°C for 60 minutes, washed with water and, thereafter, saturated again with an aqueous solution including 0.5% of an aqueous solution of 36% hydrogen peroxide aqueous solution, 0.1% of sodium hydroxide and 0.3% of sodium silicate, heated with steam at a temperature of 100°C for 60 minutes and, finally, rinsed with water to remove the bleaching solution.

The bleached fabric was mercerized with an aqueous solution containing 20% of sodium hydroxide at a temperature of 20°C, neutralized and, then, rinsed with water.

The mercerized fabric was dyed in a desired manner as detailed in the following examples.

B. The scouring property of the sized yarn fabric was evaluated by a method wherein the scoured fabric having a length of 20 cm was cut along the length of the fabric into 20 pieces having a width of 2 cm, and one end of each of the pieces was dipped into an aqueous solution containing 0.5% of Patent Pure Blue V (C. I. Acid Blue No. 1, C. I. No. 42045) so as to allow penetration of the dye solution upward into the fabric. Ten minutes after the start of the dipping, the length of the upward penetration of the dye solution was measured. The scouring property of the sized yarn fabric was indicated by an average value of the length of upward penetration of the dye solution and the deviations in the measured values of the penetrating length for the 20 pieces.

C. The bleaching property of the sized yarn fabric was determined by a method wherein 20 pieces of the bleached fabric, prepared in the same manner as for the scoured fabric, were subjected to measurement of their reflectivity at a wave length of 450 m$\mu$ using a spectrophotometer. The bleaching property of the sized yarn fabric was indicated by an average value of the measured reflectivities for the 20 pieces and the deviation in the measured values for the 20 pieces.

D. The dyeing property of the sized yarn fabric was determined by a method in which 20 pieces of the dyed fabric prepared in the same manner as for the scoured fabric, were subjected to measurement of their reflectivity at a main wave length of the dye used for the dyeing, using a spectrophotometer. The dyeing property of the sized yarn fabric was indicated by an average value of the measured reflectivities for the 20 pieces and the deviation in the measured values for the 20 pieces.

EXAMPLES 1 and 2

In Example 1, a mixture of 50% of methyl methacrylate and 50% of butyl methacrylate was copolymerized in a mixture solvent consisting of 50% of methyl alcohol and 50% of ethyl alcohol in the presence of 1% of lauroyl peroxide at a temperature of 55°C for 5 hours while reflowing by a reflux condenser. The copolymerization product was separated from the reaction mixture by way of filtration and dried at a temperature of 70°C under a reduced pressure. The resulting copolymer had a glass transition point of 68.5°C and a Young's modulus of $7.9 \times 10^3$ kg/cm$^2$. Based on the adhesion test, the copolymer had no adhesive property.

The copolymer was dissolved in trichloroethylene in order to prepare a solution containing 5.0% of the copolymer.

A cotton single yarn having a cotton count of 40 $s$ was immersed into the copolymer solution and squeezed with a mangle so as to maintain 6% of the solid copolymer on the cotton yarn and, thereafter, dried at a temperature of 60°C. A sized cotton yarn in accordance with the present invention was obtained. The sized cotton yarn had kinetic frictional coefficients at 20°C and 65% relative humidity, 30°C and 60% relative humidity and 20°C and 80% relative humidity, as well as resistances to abrasion and a desizing property as indicated in Table 2.

The sized cotton yarn was utilized as a warp yarn and a non-sized cotton single yarn of 40 $s$ cotton count was used as a weft yarn to weave a plain cotton fabric having a warp density of 120 yarns/in and a weft density of 65 yarns/in by using an automatic loom. During the weaving, the separation of the copolymer sizing agent from the cotton yarn and formation of fluffs of the cotton fabric were observed, and number of uarn breakages was counted during the period of time in which 60 cm of the fabric was produced.

The cotton fabric was singed, desized, scoured, bleached and mercerized using the method as stated hereinbefore. The mercerized cotton fabric was immersed in a dyeing solution containing 30 g/liter of (C. I. Reactive Brown No. 1, C. I. No. 26440) Cibacron Brown 3GR - A,(a trademark of a reactive dye made by Ciba-Geigy), 50 g/litre of sodium sulfate anhydride, 20 g/liter of sodium carbonate and 10 g/litre of heptadecyl-N-benzylbenzimidazole (Albatex PO, a trademark of a leveling agent made by Ciba-Geigy), squeezed with a mangle so as to be impregnated with 75% of the dye solution and, then, heated with superheated steam of a temperature of 120°C for 1 minute. The dyed cotton fabric was rinsed with water and dried.

The scoured fabric, bleached fabric and dyed fabric were respectively subjected to the testing of their scouring property, bleaching property and dyeing property of the sized cotton fabric, using the methods as mentioned hereinbefore. The results are indicated in Table 2.

In Example 2, the same procedures as in Example 1 were repeated except that the copolymer was prepared using styrene instead of methyl methacrylate. The styrene-butyl methacrylate copolymer had a glass transition point of 62.3°C, a Young's modulus of $8.5 \times 10^3$ kg/cm$^2$ and exhibited an excellent anti-adhesive property based on the adhesion test.

For comparison, Comparison Examples 1 through 5 were carried out using the same procedures as in Example 1, and using, as the sizing agent copolymer: a copolymer consisting of 59% methyl methacrylate, 39% of butyl methacrylate and 2% of acrylic acid in Comparison Example 1; a copolymer consisting of 30% of methyl methacrylate, 30% of butyl methacrylate, 38% of ethyl acrylate and 2% of crotonic acid in Comparison Example 2; a copolymer consisting of 50% of vinyl acetate and 50% of vinyl chloride in Comparison Example 3; a homopolymer of methyl methacrylate in Comparison Example 4, and; a homopolymer of butyl methacrylate in Comparison Example 5. The results are indicated in Table 2.

Table 2

| | | | Example | | Comparison Example | | | | |
|---|---|---|---|---|---|---|---|---|---|
| | | | 1 | 2 | 1 | 2 | 3 | 4 | 5 |
| Property of sized yarn | Kinetic frictional coefficient | 20°C 65% RH | 0.356 | 0.354 | 0.361 | 0.372 | 0.371 | 0.353 | 0.391 |
| | | 30°C 60% RH | 0.368 | 0.365 | 0.368 | 0.431 | 0.382 | 0.361 | 0.445 |
| | | 20°C 80% RH | 0.361 | 0.357 | 0.398 | 0.422 | 0.388 | 0.355 | 0.396 |
| | Resistance to abrasion | | 436 | 431 | 450 | 410 | 401 | 290 | 420 |
| | Desizing ratio (%) | | 99.3 | 99.2 | 96.8 | 96.3 | 98.6 | 97.2 | 99.5 |
| Weaving properties of sized yarn | Formation of fluffs | | 2 | 2 | 2 | 4 | 2 | 5 | 3 |
| | Separation of sizing agent | | 1 | 1 | 1 | 4 | 2 | 5 | 4 |
| | Number of yarn breakage | | 5 | 7 | 4 | 19 | 8 | 30 | 17 |
| Processing properties of sized yarn | Scouring | Penetration (mm) | 75 | 71 | 67 | 64 | 71 | 74 | 75 |
| | | Deviation | 2 | 3 | 5 | 7 | 6 | 2 | 2 |
| | Bleaching | Whiteness (%) | 91 | 90 | 88 | 88 | 90 | 91 | 91 |
| | | Deviation | 3 | 5 | 5 | 7 | 8 | 2 | 2 |
| | Dyeing | Reflection (%) | 10 | 11 | 13 | 13 | 11 | 9 | 10 |
| | | Deviation | 3 | 4 | 9 | 10 | 8 | 3 | 2 |

As Table 2 clearly shows, the sizing agent copolymer of Examples 1 and 2 had excellent desizing and processing properties. The copolymers of Comparison Example 1 had very excellent weaving properties and the cotton yarn sized with the copolymer of Comparison Example 1 had a very high resistance of abrasion. However, the sized cotton yarn of Comparison Example 1 had poor processing properties. Such properties. Such properties of the copolymer of Comparison Example 1 may be derived from the presence of acrylic acid as a copolymeric component.

The sized cotton yarn of Comparison Example 2 had a high frictional coefficient at a relatively high temperature or relative humidity. This resulted in a high number of separations of the sizing agent copolymer from the cotton yarn and a large number of yarn breakages during the weaving.

The sized cotton yarn of Comparison Example 3 had a relatively high desizing property. However, the sized yarn was relatively poor in processing property. This may be because of the presence of vinyl acetate as a copolymerizing component, which has a high affinity to the cellulosic fibers.

The sized cotton yarn of Comparison Example 4 had relatively high processing properties. However, the sized yarn was very poor in weaving properties and resistance to abrasion. This may be because of a relatively high hardness of the methyl methacrylate homopolymer.

The sized cotton yarn of Comparison Example 5 had relatively high frictional coefficients and processing properties. However, this sized yarn had poor weaving properties. This may be because of a relatively high softness of the butyl methacrylate homopolymer.

Consequently, the sizing agent copolymers of Examples 1 and 2 in accordance with the present invention could impart well-balanced properties to the cotton yarn with regard to frictional properties, resistance to abrasion, desizing property, weaving properties and processing properties. Especially, the sized yarns and the sized fabrics of Examples 1 and 2, respectively, had excellent weaving properties and superior processing properties.

EXAMPLES 3 through 7

In Examples 3 through 7, the same operations as in Example 1 were repeated 5 times using copolymers of methyl methacrylate and butyl methacrylate in proportions as indicated in Table 3. In each Example, the copolymer was dissolved in trichloroethylene in a concentration of 5%, and the solution was applied to the cotton single yarn so as to impregnate the cotton yarn with 140% of the solution based on the weight of the cotton yarn. The results are indicated in Table 3.

For comparison, the same procedures as in Example 3 were repeated in comparison Examples 6 and 7 using copolymers of methyl methacrylate and butyl methacrylate in the proportions as indicated in Table 3.

TABLE 3

| | | | Comparison Example 6 | Example 3 | Example 4 | Example 5 | Example 6 | Example 7 | Comparison Example 7 |
|---|---|---|---|---|---|---|---|---|---|
| Composition of copolymer (%) | MMA | | 15 | 35 | 35 | 50 | 65 | 75 | 85 |
| | DMA | | 85 | 75 | 65 | 50 | 35 | 25 | 15 |
| Properties of copolymer | Glass transition point (%) | | 37.8 | 48.1 | 59.2 | 68.5 | 69.4 | 74.6 | 83.2 |
| | Young's modulus ($\times 10^3$ kg/cm$^2$) | | 0.38 | 4.9 | 6.3 | 7.9 | 3.5 | 8.9 | 9.9 |
| Resistance to abrasion of sized yarn | | | 482 | 465 | 450 | 436 | 412 | 401 | 350 |
| Weaving properties of sized yarn | Formation of fluffs | | 3 | 1 | 1 | 2 | 2 | 2 | 3 |
| | Separation of sizing agent | | 4 | 1 | 1 | 1 | 1 | 12 | 8 |
| | Number of yarn breakages | | 15 | 3 | 4 | 5 | 6 | 3 | 11 |
| Processing properties of sized yarn | Scouring | Penetration (mm) | 76 | 76 | 76 | 75 | 75 | 76 | 73 |
| | | Deviation | 2 | 2 | 2 | 2 | 2 | 3 | 5 |
| | Bleaching | Whiteness (%) | 91 | 90 | 91 | 91 | 90 | 90 | 90 |
| | | Deviation | 2 | 3 | 2 | 3 | 3 | 3 | 5 |
| | Dyeing | Reflection (%) | 10 | 10 | 11 | 10 | 10 | 10 | 11 |
| | | Deviation | 2 | 3 | 3 | 3 | 2 | 3 | 5 |

In Comparison Example 6, the sizing agent copolymer consisting of 15% of methyl methacrylate and 85% of butyl methacrylate had a very low glass transition point of 37.8°C, a very low Young's modulus of 0.38 $\times 10^3$ kg/cm$^2$ and an undesirably high adhesive property. The cotton yarn sized by the copolymer of Comparison Example 6 had poor weaving properties due to a large formation of fluffs on the woven fabric, a large separation of the sizing agent copolymer from the yarn and a large number of yarn breakages during the weaving. This is because of the high softness of the copolymer which is rich in butyl methacrylate content.

In Comparison Example 7, the sizing agent copolymer consisting of 85% of methyl methacrylate and 15% of butyl methacrylate had a very high glass transition point and Young's modulus. These properties result in a poor resistance to abrasion of the yarn sized by the copolymer. Further, it was observed in the weaving of the sized cotton yarn of Comparison Example 7 that a large number of fluffs were formed on the woven fabric, a large amount of sizing agent was separated from the sized yarn and the sized yarn was very frequently broken.

From the results shown in Table 3, it is obvious that the copolymers of Examples 3 through 7, which consist of 20 to 80% of methyl methacrylate and 80 to 20% of butyl methacrylate, are suitable as sizing agents for the cellulosic fiber yarns.

EXAMPLE 8

In order to prepare a copolymer, 100 parts by weight of a mixture of 40% of methyl methacrylate and 60% of 2-ethylhexyl methacrylate (EHMA) and 1.2 parts by weight of benzoyl peroxide was dispersed in 250 parts by weight of an aqueous solution containing 2.0% of polyvinyl alcohol, 2.0% of sodium sulfate and 0.005% of sodium nitrite. The dispersion was raised to a temperature of 70°C during 30 minutes and, then, maintained at 70°C for 60 minutes. The resultant copolymer was filtered, rinsed with water, washed with an aqueous solution of 0.1% of sodium hydroxide, rinsed with water and dried. The copolymer was in the form of particles having 100 to 500 $\mu$ size, and had a glass transition point of 52°C, a Young's modulus of $2.2 \times 10^3$ kg/cm$^2$. As a result of the adhering test, the copolymer was found to have substantially no adhesive property. The copolymer was dissolved in trichloroethylene to prepare a 3.3% solution. The solution was used to size a blend spun yarn having a cotton count of 44 *s* and consisting of 35% of cotton fibers and 65% of polyethylene terephthalate fibers, using a slasher type sizing machine at room temperature and a velocity of 18 m/min, and the sized yarn was dried at a temperature of 52°C. The yarn was impregnated with 5.2% of the sizing agent copolymer based on the weight of the yarn.

A plain fabric was woven using the above-sized yarn as a warp and the same non-sized cotton-polyethylene terephthalate fiber blend yarn as stated above as a weft, at a warp density of 136 yarns/in and a weft density of 72 yarns/in. The woven fabric was singed, desized, scoured, bleached, mercerized and dyed in a method similar to that in Example 1. In the bleaching step, the scoured fabric was saturated with an aqueous solution of 1% of an aqueous solution containing 50% of sodium chloride and 0.8% of ethyl tartrate, heated with steam at 100°C for 60 minutes, rinsed with water and, thereafter, saturated with an aqueous solution containing 0.5% of an aqueous solution containing 36% of hydrogen peroxide, 0.1% of sodium hydroxide and 0.3% of sodium silicate, heated at 100°C for 60 minutes with steam, and washed with water. Also, in the dyeing step, the mercerized fabric was padded with an aqueous dyeing liquid containing 20 g/liter of I. C. Disperse Red No. 74 (Foron Scarlet BWFL Liquid, a trademark of Sandoz) and 20 g/liter of C. I. Reeactive Red No. 24 (Cibacron Brilliant Red BD, trademark of Ciba-Geigy), dried, heated at a temperature of 190°C for 2 minutes, washed with an aqueous solution containing 1 g/liter of sodium carbonate and 0.5 g/liter of polyoxyethylene alkylphenol ether (Nonipol B, trademark of a detergent made by Sanyo Kasei Kogyo K. K., Japan), and dried. The sized yarn and fabric had properties as shown in Table 4.

For comparison, the same procedures as in Example 8 were repeated in Comparison Examples 8 through 11 except that: In Comparison Example 8, a copolymer consisting of 39% of methyl methacrylate, 58% of 2-ethylhexyl methacrylate and 3% of acrylic acid was used; in Comparison Example 9, a copolymer consisting of 50% of vinyl acetate and 50% of vinyl chloride was used; in Comparison Example 10, a homopolymer of methyl methacrylate was used, and; in Comparison Example 11, a homopolymer of 2-ethylhexyl methacrylate was used. The results are indicated in Table 4.

From Table 4, it is obvious that the sized yarn and fabric in accordance with the present invention had an excellent resistance to abrasion, desizing property, weaving properties and processing properties and proper frictional coefficients at a room temperature from 20° to 30°C and a relative humidity of 60 to 80%. Compared with this, the sized yarns of Comparison Examples 8 and 9 had poor processing properties, and the sized yarns of Comparison Examples 10 and 11 were poor in weaving properties.

TABLE 4

| | | | Example 8 | Comparison 8 | 9 | 10 | 11 |
|---|---|---|---|---|---|---|---|
| Properties of sized yarn | Kinetic frictional coefficient | 20°C 65% RH | 0.333 | 0.339 | 0.336 | 0.316 | 0.347 |
| | | 30°C 60% RH | 0.341 | 0.343 | 0.314 | 0.320 | 0.412 |
| | | 20°C 80% RH | 0.335 | 0.340 | 0.340 | 0.319 | 0.350 |
| | Resistance to abrasion | | 524 | 535 | 510 | 360 | 530 |
| | Desizing ratio (%) | | 99.2 | 97.1 | 97.0 | 97.4 | 99.4 |
| Weaving properties of sized yarn | Formation of fluffs | | 1 | 1 | 2 | 3 | 4 |
| | Separation of sizing agent | | 1 | 1 | 1 | 3 | 4 |
| | Number of yarn breakages | | 2 | 2 | 3 | 10 | 15 |
| Processing properties | Scouring | Penetration (mm) | 69 | 60 | 62 | 63 | 70 |
| | | Deviation | 2 | 7 | 6 | 4 | 2 |
| | Bleaching | Whiteness (%) | 93 | 87 | 89 | 91 | 93 |
| | | Deviation | 3 | 8 | 6 | 3 | 2 |
| | Dyeing | Reflection (%) | 14 | 11 | 11 | 13 | 14 |

TABLE 4-continued

| | Example 8 | Comparison 8 | 9 | 10 | 11 |
|---|---|---|---|---|---|
| Deviation | 2 | 8 | 7 | 3 | 2 |

EXAMPLE 9

In the same copolymerization method as in Example 1, a copolymer was prepared from 60% of methyl methacrylate and 40% of pentyl methacrylate. The copolymer had a glass transition point of 60°C, a Young's modulus of $3.8 \times 10^3$ kg/cm² and non-adhesive property. The copolymer was dissolved in tetrachloroethylene to prepare its 4% solution.

A blend spun yarn consisting of 50% of cotton fibers and 50% viscose rayon fibers and having a cotton count of 40 *s*, was immersed in the above-prepared solution and squeezed so as to retain 6.5% of the solid copolymer on the yarn. The sized blend spun yarn had a resistance to abrasion of 511 and kinetic frictional coefficients of 0.314 at 20°C and 65% RH, .325 at 30°C and 60% RH and 0.318 at 20°C and 80% RH. The sizing agent copolymer on the yarn was desized at a desizing percentage of 99.1.

A plain fabric was woven using a warp consisting of the sized yarn and a weft consisting of a non-sized yarn at a warp density of 120 yards/in and a weft density of 65 yarns/in. During the weaving, it was observed that very small formations of fluffs on the woven fabric, very small separations of the sizing agent from the fabric and very few number (4 times) of yarn breakages occurred. The woven fabric was uniformly singed, scoured, bleached, mercerized and dyed. It was observed that the fabric had superior uniformity in processing properties.

EXAMPLES 10, 11 and 12

In each of Examples 10 through 12, a copolymer was prepared by copolymerizing a mixture of methyl methacrylate and n-butyl acrylate in the proportion indicated in Table 5, in a mixture solvent consisting of 50% of methyl alcohol and 50% of ethyl alcohol in the presence of 1% of an initiator consisting of lauroyl peroxide based on the weight of the monomer mixture at a temperature of 50°C for 5 hours while reflowing by a reflux condenser. The resulting copolymer was filtered and dried at a temperature of 70°C under a reduced pressure. The copolymer was dissolved in trichloroethylene in a concentration of 3.3%. Each of the copolymers thus prepared had a glass transition point and Young's modulus as indicated in Table 5 and no adhesive property.

In each of Examples 10 through 12, the copolymer solution was applied to a blend spun single yarn, consisting of 35% of cotton fibers and 65% of polyethylene terephthalate fibers and a cotton count of 44 *s* in the same method as in Example 1 and dried at a room temperature so as to impregnate the yarn with about 5% of the solid copolymer based on the weight of the yarn. The sized yarns in Examples 10 through 12 were subjected to testing for resistance to abrasion and desizing property. The sized yarns were used in weaving of a plain fabric composed of 144 warps per inch consisting of the sized yarn and 76 wefts per inch consisting of the non-sized cotton-polyethylene terephthalate blend spun yarn. During the weaving, the weaving properties of the sized yarns were observed.

For comparison, the same operations as in Example 10 were repeated in Comparison Examples 12 and 13 using copolymers as indicated in Table 5. The results of the tests for the comparison examples are indicated in Table 5.

As Table 5 clearly shows, the methyl methacrylate copolymers of the present invention having both the glass transition point between 40° and 80°C and the Young's modulus between $1 \times 10^3$ and $1 \times 10^4$ kg/cm² had suitable properties as a sizing agent for the cellulosic fiber yarn. However, the copolymers of the comparison examples outside the present invention resulted in a sized yarn poor in weaving properties.

Table 5

| | | Comparison Example 12 | Example 10 | 11 | 12 | Comparison Example 13 | Original yarn (control) |
|---|---|---|---|---|---|---|---|
| Composition of copolymer (%) | Methyl methacrylate | 50 | 60 | 70 | 80 | 90 | — |
| | n-Butyl acrylate | 50 | 40 | 30 | 20 | 10 | — |
| Properties of copolymer | Glass transition point (°C) | 36.6 | 40.6 | 55.7 | 79.5 | 83.1 | — |
| | Young's modulus ($\times 10^3$ kg/cm²) | 4.0 | 4.4 | 4.9 | 9.7 | 9.9 | — |
| | Non-adhesive property | adhesive | non adhesive | | | | — |
| Properties of sized yarn | Pick up (%) | 5.4 | 5.0 | 4.9 | 5.2 | 4.8 | — |
| | Resistance to abrasion | 558 | 546 | 535 | 408 | 371 | 121 |
| | Desizing ratio (%) | 99.3 | 98.5 | 98.4 | 98.6 | 97.3 | — |
| | Formation | | | | | | |

Table 5-continued

| | | Comparison Example 12 | Example 10 | Example 11 | Example 12 | Comparison Example 13 | Original yarn (control) |
|---|---|---|---|---|---|---|---|
| Weaving properties of sized yarn | of fluffs | 3 | 1 | 1 | 2 | 3 | 5 |
| | Separation of sizing agent | 3 | 1 | 1 | 2 | 3 | — |
| | Number of yarn breakages | 15 | 2 | 3 | 7 | 13 | Impossible to weave |

EXAMPLES 13 and 14

In Example 13, a copolymer was prepared by copolymerizing a mixture of styrene and ethyl acrylate in the proportions shown in Table 6, in a mixture solvent consisting of 50% of methyl alcohol and 50% of ethyl alcohol, in the presence of an initiator consisting of azo-bis-isobutyronitrile at a temperature of 60°C for 5 hours while refluxing. The resulting copolymer was filtered and dried at a temperature of 70°C under a reduced pressure. The copolymer had the properties as indicated in Table 6. The copolymer was dissolved in 1,1,1-trichloroethane to prepare a 3.6% solution of the copolymer.

The copolymer solution was applied to a cotton yarn, of a cotton count of 40 *s*, by immersing it into the solution, squeezing with a mangle and drying at room temperature, so as to maintain 6% of the solid copolymer based on the weight of the yarn, on the yarn. The sized yarn was subjected to testing for the resistance to abrasion. The desizing ratio of the sized yarn was determined by washing it with a 1,2-difluoro-1,1,2,2-tetrachloroethane in a weight of 30 times that of the sized yarn at a temperature of 60°C for 20 seconds and calculating in accordance with the aforementioned formula.

In Example 14, the same procedures as in Example 13 were repeated using a copolymer in the composition as indicated in Table 6. The properties of the copolymer and sized yarn of Example 14 are indicated in Table 6.

For comparison, the same operations as in Example 13 were repeated using copolymers in the compositions as detailed in Table 6. The results are indicated in Table 6.

In order to observe the weaving property, the sized yarns prepared above were utilized as a warp for plain fabric having a warp density of 120 yarns/in and a weft density of 65 yarns/in, in which fabric a non-sized cotton yarn of 40 *s* cotton count was used as a weft. The weaving properties as observed are indicated in Table 6.

Table 6

| | | Comparison Example 14 | Example 13 | Example 14 | Comparison Example 15 |
|---|---|---|---|---|---|
| Composition of copolymer | Styrene | 40 | 50 | 70 | 80 |
| | Ethyl acrylate | 60 | 50 | 30 | 20 |
| Property of Copolymer | Glass transition point (°C) | 33.0 | 41.8 | 65.4 | 77.0 |
| | Yong's modulus (× $10^3$ kg/cm²) | 0.78 | 2.5 | 8.8 | 16 |
| Property of sized yarn | Pick up (%) | 4.8 | 5.1 | 5.1 | 5.0 |
| | Kinetic frictional coefficient | 1.4 | 0.9 | 0.6 | 9.5 |
| | Resistance to abrasion | 273 | 466 | 420 | 369 |
| | Desizing ratio (%) | 98.0 | 98.4 | 98.4 | 98.3 |
| Weaving property of sized yarn | Formation of fluffs | 4 | 1 | 2 | 3 |
| | Separation of sizing agent | 3 | 1 | 1 | 3 |
| | Number of yarn breakages | 20 | 4 | 7 | 14 |

From Table 6, it is obvious that all of the copolymers applied onto the cotton yarns of Examples 13 and 14 and Comparison Examples 14 and 15 could be removed in a very high desizing ratio from the yarns. However, the cotton yarn sized by the copolymer of Comparison Example 14, having a Young's modulus lower than $10^3$ kg/cm² and a glass transition point lower than 40°C, had a large frictional coefficient, a poor resistance to abrasion and a poor weaving properties, despite a ratio of styrene to ethyl acrylate in the copolymer within the range of from 20 : 80 to 80 : 20. This may be because of the high softness of the copolymer.

Further, it is evident that the cotton yarn sized by the copolymer of Comparison Example 15, having a Young's modulus higher than $10^4$ kg/cm², had a relatively low resistance to abrasion and poor weaving properties, in spite of a ratio of styrene to ethyl acrylate within the range of from 20 : 80 to 80 : 20. This may be because of the high hardness of the copolymer.

Compared with the results of the comparison examples, in Examples 13 and 14 the cotton yarns sized by the copolymers, having both a glass transition point between 40° and 80°C and a Young's modulus between $11 \times 10^3$ and $1 \times 10^4$ kg/cm², had a high resistance to abrasion of more than 400 and excellent weaving properties.

EXAMPLES 15 through 17

In Example 15, a copolymer was prepared by copolymerizing a mixture of 40% of n-butyl acrylate and 60% of methyl methacrylate in a mixture solvent of 50% of methyl alcohol and 50% of ethyl alcohol in the presence of 1% of an initiator consisting of lauroyl peroxide, based on the weight of the monomer mixture, at a temperature of 55°C, for 5 hours, while refluxing. The resultant copolymer was filtered and dried at a temperature of 70°C under a reduced pressure. The copolymer had a glass transition point of 40.6°C, a Young's modulus of $4.4 \times 10^3$ kg/cm² and a non-adhesive property. The copolymer was dissolved in dichloromethane and the solution was applied onto a spun single yarn, consisting of 65% of polyethylene terephthalate fibers and 35% of cotton yarns and having a cotton count of 45 *s*, using a slasher sizing machine so as to apply 3.0% of the copolymer onto the yarn. The sizing operation was carried out at room temperature, at a velocity of 20 m/min, and the sized yarn was dried at a temperature of 48°C. The sized yarn was used as a warp to produce a woven fabric having a warp density of 136 yarns/in and a weft density of 72 yarns/in. The properties of the copolymer and sized yarn are indicated in Table 7.

In Examples 16 and 17, the same operations as in Example 15 were repeated except that the pick up in percent of the copolymers on the cotton yarns are, respectively, 8 and 18% based on the weight of the yarn.

In Comparison Examples 16 and 17, the same operations as in Example 15 were repeated except that the copolymers were respectively applied onto the cotton yarns in a pick up of 2.8 and 22%. The sized yarns of Comparison Examples 16 and 17 had properties as shown in Table 7.

Table 7

| Item | Example | Original Yarn (Control) | Comparison Example 16 | Example 15 | Example 16 | Example 17 | Comparison Example 17 |
|---|---|---|---|---|---|---|---|
| Pick up of Sizing Agent on Yarn (%) | | 0 | 2.8 | 3.0 | 8.0 | 18.0 | 22.0 |
| Resistance to Abrasion of Sized Yarn | | 118 | 343 | 407 | 850 | 1015 | 912 |
| Weaving Property of Sized Yarn | Formation of Fluffs | 5 | 3 | 2 | 1 | 1 | 3 |
| | Separation of Sizing Agent | — | 1 | 1 | 1 | 2 | 4 |
| | Number of Yarn Breakages | Impossible to weave | 11 | 7 | 2 | 4 | 13 |

From Table 7, it is observed that the sized yarn on which the sizing agent copolymer is applied in an amount smaller than 3% or larger than 20%, based on the weight of the yarn, has a poor weaving property. That is, in order to obtain a good weaving property, it is desirable that the sizing agent copolymer is applied onto the yarn in an amount between 3 to 20%, based on the weight of the yarn.

EXAMPLES 18 and 19

In Example 18, a copolymer was prepared by copolymerizing a mixture of 70% of methyl methacrylate and 30% of n-butyl acrylate in a mixture solvent consisting of 50% of methyl alcohol and 50% of ethyl alcohol in the presence of 1%, based on the weight of the monomer mixture, of an initiator consisting of lauroyl peroxide, at a temperature of 55°C for 5 hours, with reflux. The copolymer was filtered and dried at a temperature of 70°C under a reduced pressure. The copolymer was dissolved in trichloroethylene to prepare a 4.0% solution of the copolymer. A cotton single yarn, consisting of 65% of cotton fibers and 35% of polyethylene terephthalate and having a cotton count of 45 *s*, was immersed into the polymer solution at room temperature and squeezed with a mangle so that about 5%, based on the weight of the yarn, and, then, dried at room temperature. The properties of the copolymer and sized yarn were determined by the method mentioned hereinbefore. Further, in order to observe the weaving property, the sized yarn was woven as a warp into a plain fabric having a warp density of 136 yarns/in and a weft density of 72 yarns/in wherein the weft was composed of a non-sized spun single yarn the same as used for the warp.

In Example 19, the same procedures as in Example 18 were repeated except that a copolymer was prepared by dispersing 10 parts by weight of the same monomer mixture as in Example 18 and 0.1 part by weight of lauroyl peroxide into 25 parts by weight of an aqueous solution containing 2.5% of polyvinyl alcohol, 2.5% of sodium sulfate and 0.005% of sodium nitrite, and heating the dispersion at a temperature of 70°C for 6 hours.

In Comparison Example 18, the same procedures as in Example 18 were repeated using the initiator, lauroyl peroxide, in an amount of 2.0% based on the weight of the monomer mixture.

In Comparison Example 19, the same operations as in Example 19 were repeated using the initiator, lauroyl peroxide, in an amount of 0.005 part by weight. The properties of the copolymers and sized yarns are indicated in Table 8.

In Table 8, it is indicated that the spun yarn sized by the copolymers of Comparison Examples 18 and 19, which have a Young's modulus out the range of from $10^3$ to $10^4$ kg/cm$^2$, had a relatively low resistance to abrasion and a poor weaving property.

Table 8

| Item | Example | Comparison Example 18 | Example 18 | Example 19 | Comparison Example 19 |
|---|---|---|---|---|---|
| Property of Copolymer | Glass Transition Point (°C) | 48.1 | 69.2 | 68.8 | 69.0 |
| | Young's Modulus (× $10^3$ kg/cm$^2$) | 0.26 | 7.9 | 8.6 | 14 |
| Property of Sized Yarn | Pick up (%) | 4.9 | 5.2 | 5.3 | 5.2 |
| | Resistance to Abrasion | 383 | 502 | 507 | 380 |
| | Desizing ratio (%) | 99.5 | 99.2 | 99.2 | 97.0 |
| Weaving Property of Sized Yarn | Formation of Fluffs | 3 | 1 | 1 | 2 |
| | Separation of Sizing Agent | 3 | 1 | 1 | 3 |
| | Number of Yarn Breakages | 9 | 3 | 3 | 9 |

What we claim is:

1. A method for sizing cellulosic fiber containing yarns in a non-aqueous medium, comprising the steps of:

providing a non-aqueous sizing solution by dissolving a copolymer in a halogenated hydrocarbon solvent wherein said halogenated hydrocarbon is selected from the group consisting of trichloroethylene, tetrachloroethylene, 1,1, (1)-trichloroethane, dichloromethane, 1,2- difluoro -1,1, (2) ,2 -tetrachloroethane, 1,1,2- trifluoro- 1,2,2 - trichloroethane, monofluorotrichloromethane, or mixtures of two or more of the above-mentioned compounds; said copolymer consisting of 20 to 80% by weight of at least one monomer component selected from the group consisting of methyl methacrylate and styrene and 80 to 20% by weight of at least one monomer component selected from the group consisting of acrylic esters of saturated aliphatic alcohols having 1 to 8 carbon atoms and methacrylic esters of aliphatic saturated alcohols having 4 to 8 carbon atoms, and said copolymer having a glass transition point of 0°C to 80°C and a Young's modulus of $1 \times 10^3$ to $1 \times 10^4$ kg/cm$^2$;

impregnating a cellulosic fiber-containing yarn with an amount of said non-aqueous sizing solution such that the yarn holds 3 to 20% od said copolymer based on the weight of the yarn and;

removing said halogenated hydrocarbon solvent from said impregnated cellulosic fiber-containing yarn.

2. A method as claimed in claim 1, wherein said monomer component selected from the group consisting of methyl methacrylate and styrene is in an amount of 40 to 70% by weight, and said monomer component selected from the group consisting of said acrylic esters and said methacrylic esters is in an amount of 60 to 30% by weight.

3. A method as claimed in claim 1, wherein said acrylic ester of said saturated aliphatic alcohol is selected from the group consisting of methyl acrylate, ethyl acrylate, n-propyl acrylate, isopropyl acrylate, n-butyl acrylate, isobutyl acrylate, n-pentyl acrylate, n-hexyl acrylate, n-heptyl acrylate, n-octyl acrylate, 2-ethylhexyl acrylate, and mixtures of two or more of above-mentioned esters.

4. A method as claimed in claim 1, wherein said methacrylic ester of said saturated alcohol is selected from the group consisting of n-butyl methacrylate, isobutyl methacrylate, n-pentyl methacrylate, n-hexyl methacrylate, n-heptyl methacrylate, n-octyl methacrylate, 2-ethylhexyl methacrylate and mixtures of two or more of the above-mentioned esters.

5. A method as claimed in claim 1, wherein the concentration of said copolymer in non-aqueous sizing solution is 2 to 13% by weight.

6. A method as claimed in claim 8, wherein said concentration of said copolymer is 4 to 7% by weight.

7. A method as claimed in claim 1, wherein said amount of said copolymer held in said yarn is 4 to 10% based on the weight of said yarn.

8. A method as claimed in claim 1, wherein said impregnating with said sizing solution is carried out by way of immersing said yarn into said sizing solution.

9. A method as claimed in claim 1, wherein said impregnating with said sizing solution is carried out by spraying the sizing solution onto said yarn.

10. A method as claimed in claim 1, wherein said impregnating with said sizing solution is carried out by brushing sizing solution onto said yarn.

11. A method as claimed in claim 1, wherein said impregnating with said sizing solution is carried out by roller coating the sizing solution onto said yarn.

12. A method for sizing cellulosic fiber-containing yarns in a non-aqueous medium, comprising the steps of:

providing a non-aqueous sizing solution by dissolving a copolymer in a halogenated hydrocarbon solvent selected from the group consisting of trichloroethylene, tetrachloroethylene and mixtures of the above-mentioned compounds, said copolymer consisting of 20 to 80% by weight of a monomer component selected from the group consisting of methyl methacrylate, styrene and mixtures of the above-mentioned compounds and 80 to 20% by weight of a monomer component selected from the group consisting of methyl acrylate, ethyl acrylate, butyl methacrylates, 2-ethylhexyl methacrylate, and said copolymer having a glass transition point of 40 to 80°C and a Young's modulus of $1 \times 10^3$ to $1 \times 10^4$ kg/cm;

impregnating a cellulosic fiber-containing yarn with air amount of said non-aqueous sizing solution such that the yarn holds 3 to 20% of said copolymer based on the weight of the yarn, and;

removing said halogenated hydrocarbon solvent from said impregnated cellulosic fiber-containing yarn.

* * * * *